United States Patent [19]

Blotenberg

[11] Patent Number: 4,936,740

[45] Date of Patent: Jun. 26, 1990

[54] METHOD OF PROTECTING A TURBOCOMPRESSOR FROM SURGING BY BLOWING OFF THROUGH A BLOW-OFF VALVE AND DEVICE FOR CARRYING OUT THE METHOD

[75] Inventor: Wilfried Blotenberg, Dinslaken, Fed. Rep. of Germany

[73] Assignee: MAN Gutehoffnungshütte GmbH, Oberhausen, Fed. Rep. of Germany

[21] Appl. No.: 321,516

[22] Filed: Mar. 9, 1989

[30] Foreign Application Priority Data

Apr. 2, 1988 [DE] Fed. Rep. of Germany ..... 3811230

[51] Int. Cl.[5] ..... F04D 27/02

[52] U.S. Cl. ..... 415/27; 415/26

[58] Field of Search ..... 415/1, 17, 26, 27, 28, 415/13

[56] References Cited

U.S. PATENT DOCUMENTS

| | | | |
|---|---|---|---|
| 4,139,328 | 2/1979 | Kuper et al. | 415/27 |
| 4,781,524 | 11/1988 | Blotenberg | 415/17 |
| 4,789,298 | 12/1988 | Blotenberg | 415/27 |
| 4,796,213 | 1/1989 | Blotenberg | 415/26 |
| 4,831,534 | 5/1989 | Blotenberg | 415/1 |
| 4,831,535 | 5/1989 | Blotenberg | 415/1 |

FOREIGN PATENT DOCUMENTS

| | | | |
|---|---|---|---|
| 3540087 | 5/1987 | Fed. Rep. of Germany | 415/17 |
| 3544821 | 6/1987 | Fed. Rep. of Germany | 415/17 |

*Primary Examiner*—Edward K. Look
*Assistant Examiner*—John T. Kwon
*Attorney, Agent, or Firm*—Max Fogiel

[57] ABSTRACT

An arrangement for protecting a turbocompressor against surges by blowing off through a blow-off valve, in which at least the flow-through of the compressor and the compressor outlet pressure are measured. A regulating parameter is determined from the measured results, as well as from predetermined reference values. A blow-off valve is adjusted dependent on the regulating parameter, by a surge-limit regulator through activating device with a downstream state regulator and a compressed medium. The blow-off valve is shifted in opening direction at a maximum rate of adjustment by safety controls when the regulating parameter exceeds a safe threshold. The compressed medium that activates the blow-off valve bypasses the state regulator and escapes directly when the safety controls engage. The compressed medium is prevented from escaping, on the other hand, when the safety controls disengage, and regulation is resumed only by the surge-limit regulator and the downstream state regulator.

6 Claims, 1 Drawing Sheet

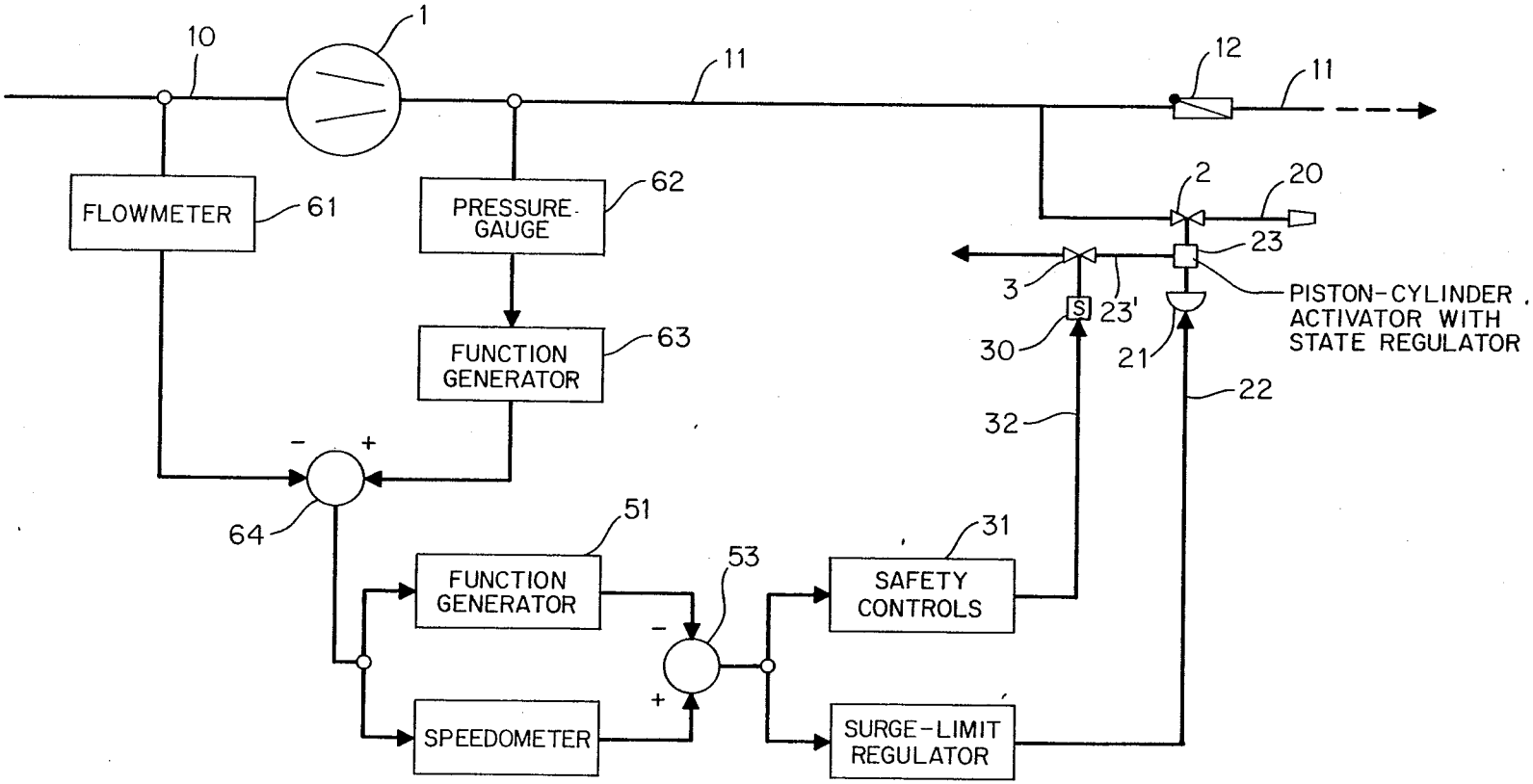
PISTON-CYLINDER ACTIVATOR WITH STATE REGULATOR
SAFETY CONTROLS
SURGE-LIMIT REGULATOR
PRESSURE GAUGE
FUNCTION GENERATOR
FUNCTION GENERATOR
SPEEDOMETER
FLOWMETER
1
2
3
10
11
11
12
20
21
22
23
23'
30
31
32
51
53
61
62
63
64
S
+
-
+
-

METHOD OF PROTECTING A TURBOCOMPRESSOR FROM SURGING BY BLOWING OFF THROUGH A BLOW-OFF VALVE AND DEVICE FOR CARRYING OUT THE METHOD

The invention concerns a method of protecting a turbocompressor from surging by blowing off through a blow-off valve, whereby a regulating parameter is determined from the results of measurements at least of the flow through the compressor and of the compressor-outlet pressure and from prescribed or prescribable reference values and is employed by a surge-limit regulator to adjust the state of the blow-off valve by way of a pneumatic or hydraulic activating mechanism with a state regulator by means of a compressed medium and whereby, when the regulating parameter exceeds a threshold of safety, safety controls shift the blow-off valve in the opening direction at a maximum rate of adjustment. The invention also concerns a device for carrying out the method.

A known method of the aforesaid type consists of a comparatively slow regulating procedure that is paralleled by rapid safety controls. The slower regulating procedure normally operates on its own and adjusts the state of the blow-off valve, or even the blow-around valve, by opening or closing it when necessary to maintain the compressor's operating point within the permissible area of a performance field. When serious and/or sudden malfunctions occur, the safety controls engage and open the blow-off valve at a maximum rate of adjustment. One drawback to the known methods is that either the maximum rate of adjustment involved in rapidly opening the blow-off valve is limited by the state regulator or that, once the safety controls have been activated, the adjustment of the blow-off valve can no longer be continued until it is completely open. The former situation demands a wide margin of safety from the surge limit and the latter has a detrimental effect on the downstream process, especially in the form of an intervention of pressure.

The object of the invention is accordingly to provide a method of the aforesaid type that avoids the aforesaid drawbacks, that operates particularly simply, and that prevents or at least inhibits detrimental effects on the downstream process. A device for carrying out the method is also to be provided.

The first half of the object is attained in accordance with the invention in a method of the aforesaid type characterized in that, when the safety controls engage, the compressed medium that activates the blow-off valve bypasses the state regulator and escapes directly and that, when the safety controls disengage, the compressed medium is prevented from escaping and the surge-limit regulator and its downstream state regulator resume the regulating procedure on their own.

The method in accordance with the invention makes it possible to adjust the blow-off valve in the rapid-opening procedure at its inherently maximum rate of adjustment independent of the state regulator and only to the extent necessary to counteract the malfunction. A blow-off or blow-around of compressed air that occurs too late, is too powerful, or takes too long is accordingly avoided, and detrimental effects, especially surging and pressure interventions in the process will no longer occur or will be powerfully attenuated. The slower response of the method to occurrences in the compressor or process that demand braking the blow-off valve are no drawback in practice because they are always associated with a non-hazardous motion of the operating point away from the surge limit. This situation, rather, provides the regulating procedure with the requisite stability by eliminating the drawback of "hunting." The resulting rapid and still moderate response on the part of the blow-off valve makes the method appropriate for even high-demand regulating procedures intended to protect the compressor from surging.

In one advantageous development of the method, the output terminal of the surge-limit regulator is readjusted practically without delay to a value that corresponds to the actual state of the blow-off valve while the safety controls are superseding the surge-limit regulator and carrying out the valve-adjustment procedure. Thus, the regulator will resume regulation smoothly and continuously once the safety controls have rapidly opened the blow-off valve, eliminating disruptive transient behavior and/or hunting by the regulator and the blow-off valve in arriving at a new stationary state.

In one preferred embodiment of the method, the difference between the actual speed-and-position value of the compressor's operating point and the associated reference speed-and-position value on a prescribed reference speed-and-position curve that represents the very limit of the possibility of still preventing surge is employed, whereby the position is the distance of the operating point from the surge limit and the speed is the speed at which the operating point is moving toward the surge limit in the compressor's performance field. This characteristic makes it possible to exploit not only where the operating point is in the performance field but also how fast it is moving through the field. The blow-off valve can always be opened at the very latest point of time at which the compressor can still be prevented from surging no matter how rapidly the operating point is approaching the surge limit. The compressor can accordingly be operating very close to the surge limit, which in particular allows effective operation at partial loads.

Depending on the design of the blow-off valve and of its activating mechanism, the valve may continue moving for some time after the safety controls have disengaged as the result for example of the energy-storage capacity of the compressed medium. To allow the blow-off valve enough time to arrive at its stationary position, the surge-limit regulator will not resume the regulating procedure once the safety controls have disengaged until a prescribed interval of time has elapsed.

The second half of the object is attained in accordance with the invention in a device with a surge-limit regulator that adjusts the state of a blow-off valve by way of a pneumatic or hydraulic activating mechanism with a state regulator and a piston-and-cylinder component and with safety controls that shift the blow-off valve in the opening direction at a maximum rate of adjustment when necessary. The device is characterized in that a switchover valve communicates at the intake end with a branch that opens between the state regulator and the piston-and-cylinder component into a compressed-medium line that connects them, in that the switchover valve communicates at the outlet end with a compressed-medium escape line, and in that the safety controls can switch the switchover valve by way of its switching input into an open state when they engage and into a closed state when they disengage.

The switchover valve is preferably magnetically operated. A magnetically operated valve is reliable and will ensure very rapid switching.

BRIEF DESCRIPTION OF THE DRAWING

A preferred embodiment of the invention will now be explained in greater detail by way of example with reference to the drawing. The sole figure is a flow chart of a turbocompressor equipped with a device in accordance with the invention. The flow chart is also intended to illustrate the method by way of example.

Compressor 1 communicates at the intake end with an intake line 10 and at the outlet end with an outlet line 11 that conveys the compressed medium to a downstream process by way of a check valve 12. Upstream of check valve 12, a blow-off line 20 that accommodates a blow-off valve 2 with a pneumatic or hydraulic activating mechanism 21 branches off from outlet line 11.

At the intake end, a flowmeter 61 that communicates with intake line 10 measures the flow of the medium being conveyed to the compressor to be compressed. A pressure gauge 62 that communicates with outlet line 11 measures the compressor-outlet pressure. Downstream of pressure gauge 62 is a function generator 63 that determines by way of data stored therein the minimum flow that is just permissible for compressor 1 in accordance with the particular pressure. The actual flow value measured by flowmeter 61 is forwarded along with the reference flow value emitted by pressure gauge 62 to a subtractor 64 that obtains a difference by subtracting the actual value from the reference value.

Downstream of subtractor 64 are a function generator 51 and a speedometer 52. Stored in function generator 51 is a reference speed-and-position value for the operating point of compressor 1. The functional values of this curve are the values at which it is still just possible to prevent the compressor from surging in accordance with the actual position and actual speed of the operating point in the performance field. Speedometer 52 determines the speed at which the compressor's operating point is moving in the performance field relative to the surge limit. This procedure can be carried out by differentiation or by obtaining a difference followed by division. The speed of the operating point (actual value) determined in speedometer 52 and the functional value (reference value) emitted by function generator 51 are subtracted from each other in a downstream subtractor 53, the reference value being subtracted from the actual value by definition. The difference generated in subtractor 53 is the regulating parameter that activates blow-off valve 2.

The accordingly generated regulating parameter is for this purpose forwarded simultaneously to safety controls 31 and to a surge-limit regulator 41 downstream of subtractor 53.

Safety controls 31 are designed to accept two switching states at their output terminal. The particular switching state that occurs depends on whether the regulating parameter has exceeded a prescribed threshold of safety in accordance with a safety curve in the performance field or not. Surge-limit regulator 41 on the other hand provides continuous regulation, meaning that it adjusts the state of blow-off valve 2 in accordance with the position of the operating point in the performance field. The output from surge-limit regulator 41 acts by way of a control line 22 on the mechanism 21 that activates blow-off valve 2. A compressed-medium line 23 extends from activating mechanism 21, which includes a state regulator, to an unillustrated piston-and-cylinder component, which generates the force that moves blow-off valve 2 in the closure direction. The force that moves blow-off valve 2 in the opening direction is for safety's sake generally generated by means of a force-storage element, a tensioned spring for example, to ensure that the valve will open automatically in the event that the regulating procedure fails.

The output terminal of safety controls 31 acts by way of a control line 32 on a safety valve 3 or, more precisely, on the electromagnetic mechanism 30 that activates it. Safety valve 3 communicates through its intake with a branch 23' that leads from compressed-medium line 23. When safety controls 31 engage, safety valve 3 is shifted into its open state and the compressed medium will bypass the mechanism 21 that activates blow-off valve 2 and escape directly. Blow-off valve 2 will accordingly move more rapidly in the opening direction until the compressor's operating point travels back into the safe-operation area of the performance field and safety controls 31 disengage, shifting the valve back into its closed state. The adjustment of blow-off valve 2 as necessary will subsequently continue, with the latest state arrived at as a point of departure, subject again to surge-limit regulator 41 and at a slower rate of adjustment.

Since components that are in themselves known can to advantage be employed for safety controls 31 and for surge-limit regulator 41, the method and device can be carried out and manufactured easily and cost-effectively.

I claim:

1. A method for protecting a turbocompressor against surges by blowing off through a blow-off valve, comprising the steps: measuring at least flow through the compressor and the compressor outlet pressure; determining a regulating parameter from said measuring step and predetermined reference values; adjusting the state of the blow-off valve dependent on said parameter by a surge-limit regulator through activating means with a downstream state regulator by a compressed medium; shifting said blow-off valve in opening direction at a maximum rate of adjustment by safety controls when said regulating parameter exceeds a safe threshold; said compressed medium that activates said blow-off valve bypassing said state regulator and escaping directly when said safety controls engage; preventing said compressed medium from escaping when said safety controls disengage, and resuming regulation only by said surge-limit regulator and said downstream state regulator, so that the blow-off valve is adjusted in a rapid-opening procedure at its maximum rate of adjustment independent of said state regulator and improper blow-off of compressed medium is prevented.

2. A method as defined in claim 1, including the step of readjusting an output terminal of said surge-limit regulator without substantial delay to a value corresponding to the actual state of said blow-off valve, said safety controls superceding said surge-limit regulator and carrying out a valve-adjustment procedure.

3. A method as defined in claim 1, wherein said turbocompressor has an operating point with an actual speed-and-position value and an associated reference speed-and-position value on a predetermined reference speed-and-position curve representing a limit at which it is still possible to prevent surge; taking the difference between said actual speed-and-position value of said operating point and said associated reference speed-and-position value on said predetermined reference speed-and-position curve, said position being the distance of said operating point from the surge limit and the speed is the speed at which said operating point moves toward the surge limit in the compressor's performance field.

4. A method as defined in claim 3, wherein said surge-limit regulator will not resume a regulating procedure after said safety controls have disengaged until a predetermined interval of time has elapsed.

5. Apparatus for protecting a turbocompressor against surges by blowing off through a blow-off valve, comprising: a blow-off valve; means for measuring at least flow through the compressor and the compressor outlet pressure; means for determining a regulating parameter from said measuring step and predetermined reference values; a surge-limit regulator with a downstream state regulator for adjusting the state of said blow-off valve dependent on said parameter by a compressed medium through activating means; safety controls for shifting said blow-off valve in opening direction at a maximum rate of adjustment when said regulating parameter exceeds a safe threshold; said compressed medium that activates said blow-off valve bypassing said state regulator and escaping directly when said safety controls engage; means for preventing said compressed medium from escaping when said safety controls disengage and resuming regulation only by said surge-limit regulator and said downstream state regulator; said activating means being fluid means with piston-and-cylinder means; an intake end and an outlet end; a branch flow line opening between said state regulator and said-piston-and-cylinder means into a connecting compressed-medium line; a switchover valve communicating at said intake end with said branch flow line; a compressed-medium escape line; said switchover valve communicating at said outlet end with said compressed-medium escape line; said switchover valve having a switching input; said safety controls switching said switchover valve through said switching input into an open state when said safety controls engage, said safety controls switching said switchover valve into a closed state when said safety controls disengage, so that the blow-off valve is adjusted in a rapid-opening procedure at its maximum rate of adjustment independent of said state regulator and improper blow-off of compressed medium is prevented.

6. Apparatus as defined in claim 5, wherein said switchover valve is a magnetically-operated valve.

* * * * *